US005330371A

United States Patent [19]

Andrews

[11] Patent Number: 5,330,371

[45] Date of Patent: Jul. 19, 1994

[54] CONNECTOR

[76] Inventor: Derek Andrews, Platanenstraat 23, Vinkel, Netherlands, 5382 KA

[21] Appl. No.: 30,990

[22] Filed: Mar. 12, 1993

[30] Foreign Application Priority Data

Mar. 26, 1992 [NL] Netherlands ..... 9200559

[51] Int. Cl.[5] ..... H01R 13/00

[52] U.S. Cl. ..... 439/579; 439/608

[58] Field of Search ..... 439/579-585, 439/607-610

[56] References Cited

U.S. PATENT DOCUMENTS

| | | | |
|---|---|---|---|
| 4,451,107 | 5/1984 | Dola et al. | 439/608 |
| 5,057,038 | 10/1991 | Bowen et al. | 439/608 |
| 5,085,596 | 2/1992 | Bowen et al. | 439/608 |

FOREIGN PATENT DOCUMENTS

| | | |
|---|---|---|
| 2345829 | 3/1976 | France . |
| 2585193 | 7/1986 | France . |
| 0446980A1 | 2/1991 | Netherlands . |
| 2104312A | 6/1982 | United Kingdom . |

OTHER PUBLICATIONS

IBM Technical Disclosure Bulletin, vol. 8, No. 8 Jan. 1966—Multiple Shielded-Wire Connector B. Dessauer and K. Schink.

*Primary Examiner*—Joseph H. McGlynn

*Attorney, Agent, or Firm*—Woodcock Washburn Kurtz Mackiewicz & Norris

[57] ABSTRACT

Connector, comprising a body of electrically insulating material, contact members fitted in the body, and an outer conductor fitted around the body, the body being provided at a contact side with one or more contact holes for receiving signal pins of a complementary connector and contacting them with the contact members, the outer conductor being provided with one or more strip-type contact springs extending along the connector, for contacting earth pins of the complementary connector, the contact springs being made integral with the outer conductor, an edge of the outer conductor lying at least in the vicinity of the contact side of the body, and the contact springs extending essentially from the said edge along the outer conductor, in such a way that the outer conductor has an essentially uninterrupted outer periphery.

20 Claims, 2 Drawing Sheets

1
2
3
4
5
6
7
8
9
10
11
12
13
14
15
16
17

CONNECTOR

BACKGROUND OF THE INVENTION

The invention relates to a connector, comprising a body of electrically insulating material, contact members fitted in the body, and an outer conductor fitted around the body, the body being provided at a contact side with one or more contact holes for receiving signal pins of a complementary connector and contacting them with the contact members, the outer conductor being provided with one or more strip-type contact springs extending along the connector for contacting earth pins of the complementary connector, the contact springs being made integral with the outer conductor, and an edge of the outer conductor lying at least in the vicinity of the contact side of the body. Such a connector is known from European patent application EP 0,446,980.

The connector known from the above-mentioned European patent application is provided with contact springs extending in the lengthwise direction of the connector, for contacting the earth pins of the complementary connector. These contact springs are made from the material of the outer conductor by making incisions in said outer conductor in the lengthwise direction, said incisions extending from the edge of the outer conductor lying at the contact side of the connector. This produces a contact spring which is connected to the outer conductor by its end facing away from the contact side, and of which the end lying at the contact side is free. The free end is bent over a short distance in the direction of the contact hole, in order to simplify the mechanical contact with the earth pin in question when joining together the complementary connector and the connector. In order to obtain a good contact with the earth pins, the free end of this known contact spring lying at the contact side is bent upwards slightly relative to the outer conductor, so that the contact spring as a whole has a bent shape, with the result that a satisfactory spring action is obtained.

The above-mentioned design of the contact spring of the known connector has, however, the disadvantage that incisions have to be made in the outer conductor in order to form the contact spring. Due to the fact that the contact springs are bent away from the outer conductor in order to obtain a spring action, the incisions are enlarged to longitudinal slits, which therefore extend on either side of each contact spring between said contact spring and the outer conductor.

When such a connector is used, energy will be radiated out from said longitudinal slits. This is a disadvantage in particular in the case of high signal frequencies, for example of the order of magnitude of 1 GHz. The energy loss which this involves in the connector results in an impedance mismatch. As is known, an impedance mismatch in a signal line produces undesirable phenomena such as reflections of the signal. The occurrence of reflections results in distortion of the signal received.

SUMMARY OF THE INVENTION

The object of the invention is to avoid the above-mentioned disadvantages and to provide a connector which at high frequencies does not produce undesired energy loss through the radiation of electromagnetic energy from openings present in the connector. For that purpose, the connector according to the invention is characterised in that the contact springs extend essentially from said edge along the outer conductor, in such a way that the outer conductor has an essentially uninterrupted outer periphery.

Through the fact that the contact springs of the connector according to the invention extend essentially from the edge of the outer conductor and are therefore with one end connected to the outer conductor on or near the edge, the incisions and the longitudinal slits resulting from them in the known connector are avoided. The end of the contact springs connected to the outer conductor preferably directly adjoins the edge of the outer conductor. The other end can be situated, for example springing freely, at some distance from the surface of the outer conductor. In principle, the contact springs extend essentially parallel to the outer conductor above the surface of the outer conductor. The fact that the contact springs are made integral with the outer conductor ensures a good mechanical and electrical connection between the outer conductor and the contact springs.

The connector according to the invention is preferably designed in such a way that the said edge of the outer conductor adjoins the contact side of the body of the connector. In other words, the outer conductor essentially completely surrounds the body of the connector in the vicinity of the contact side, but does not project beyond said body. An optimum impedance match is obtained in this way. It is, however, possible to make the outer conductor such that it projects beyond the body of the connector and thus forms a protective sleeve. The complementary connector must, of course, be adapted to accommodate this projecting part.

One or more contact springs (resilient contacting elements) can be provided on the connector according to the invention, the number of contact springs in principle depending on the number of earth pins of the complementary connector to be contacted. The contact springs can be fitted on different sides of the connector. The connector according to the invention is preferably designed in such a way that contact springs are fitted on opposite sides of the connector. Such a design has the advantage that an electrically symmetrical configuration with a constant distance between signal and earth is obtained, thus guaranteeing a good suppression of reflections. It is also possible to make the connector according to the invention in such a way that at least two adjacent contact springs are fitted on one side of the connector. For contacting several earth pins lying close together it is possible to make a single contact spring in such a way that it is split along at least a part of its length and thus forms two or more partial contact springs.

The connector according to the invention is advantageously designed in such a way that the connector is equipped for the connection of at least one coaxial cable. For this, the contact members situated in the body of the connector are equipped to receive the central conductor of a coaxial cable, while the outer conductor is provided with suitable connection members for connecting the outer conductor of the coaxial cable. The connector according to the invention is also suitable for connecting to a twin coax.

The connector according to the invention can be used in many applications, in particular in applications for high-frequency signal transmission. The connector can interact with a complementary connector which is designed for fitting on a printed circuit board, so that the connector according to the invention permits the connection of, for example, a coaxial cable on a printed circuit board. In this case it is advantageous to make the complementary connector in such a way that the contact pins are bent through a right angle. This makes it possible to make the part of the contact pins of the complementary connector which has to be inserted in the connector run parallel to the printed circuit board.

The invention therefore provides a greatly improved connector, with which at high frequencies losses due to reflections are effectively suppressed. It has been found that no disturbing reflections occur in the frequency range up to about 3 GHz. Compared with the connector described in the above-mentioned European patent application, the operating frequency can be approximately doubled with the same quantity of reflections, while the quantity of reflections is considerably reduced at the same operating frequency.

The invention will be explained by way of example with reference to the figures.

DETAILED DESCRIPTION OF THE EMBODIMENTS

Figures 1, 2:
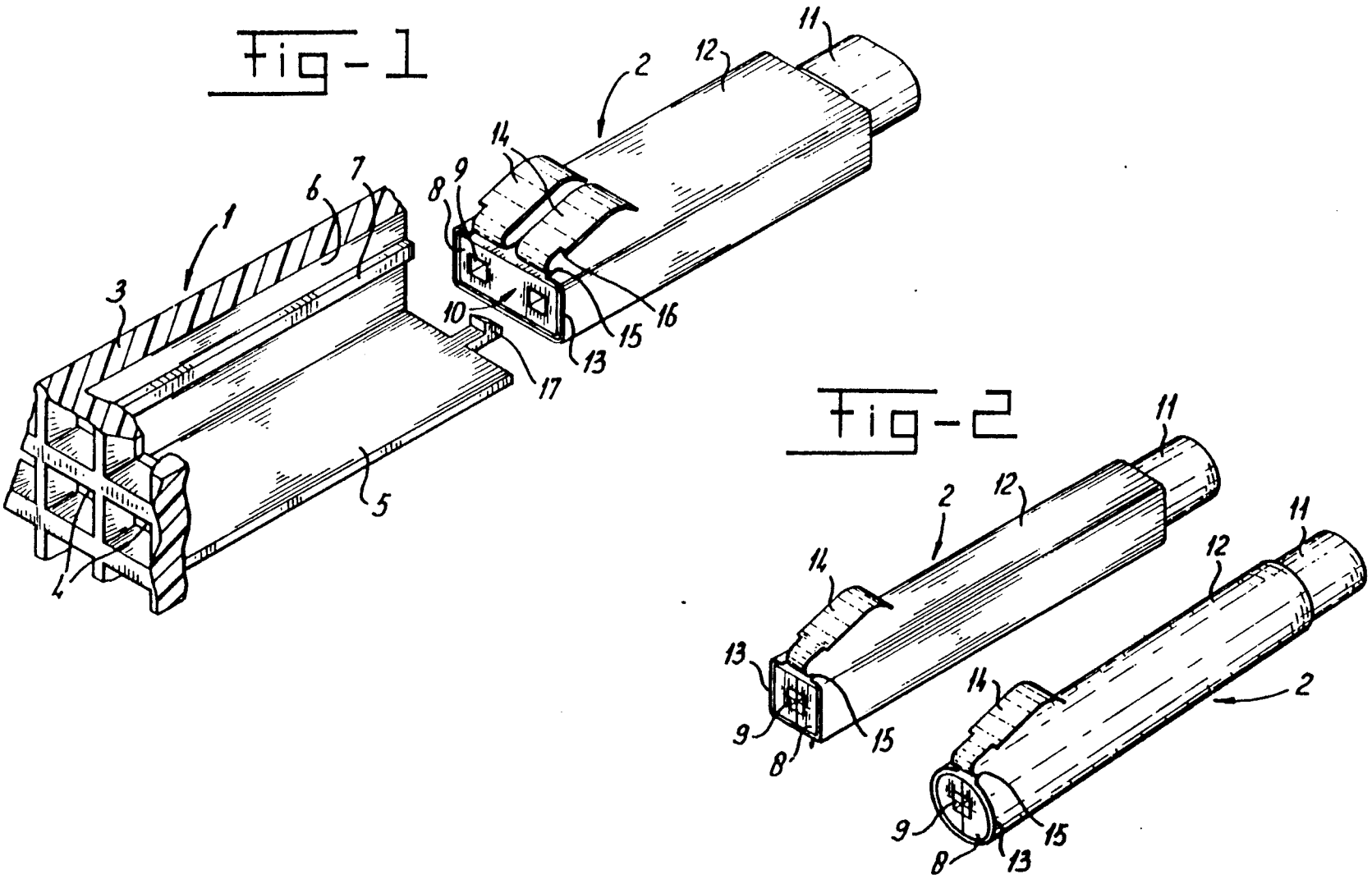
FIG. 1 shows in perspective an embodiment of the connector according to the invention.
FIG. 2 shows in perspective other embodiments of the connector according to the invention.

The connector unit shown in FIG. 1 comprises a holder 1 and a connector 2. The holder 1 comprises a body 3 which for the sake of clarity of the figure is only partially shown. The body 3 is provided with feed-through apertures 4 for feeding through contact pins of a complementary (male) connector (not shown). In FIG. 1 two feed-through apertures 4 are always situated above one another for feeding through a set of contact pins, the earth pin (not shown) being fed through the upper feed-through aperture, and the signal pin (not shown) through the feed-through aperture 4 below it. The body 3 is also provided with a supporting floor 5 and a supporting wall 6 for supporting and positioning the connector 2. A positioning rib 7 is provided on the supporting wall 6 for positioning the connector 2 during fitting of the connector 2 and when it is inserted.

The connector 2 comprises a body 8 which, like the body 3 of the holder 1, is preferably made of an electrically insulating material such as plastic. Two contact holes 9 are provided in the body 8 shown, for the accommodation of contact pins (not shown) of the complementary connector (not shown) inserted through the feed-through apertures 4. The contact holes 9 are positioned in the body 8 in such a way that when the connector is inserted they lie opposite the feed-through apertures 4 in the body 3. The side of the body 8 facing the feed-through apertures 4, in which the contact holes 9 are provided, forms the contact face 10. Provided inside the body 8, in line with the contact holes 9, are contact members (not shown) which in the fitted state are connected to the inner conductor of, for example, a coaxial cable (not shown). In the embodiment shown in FIG. 1 a twin coax or, for example, a pair of coaxial cables can be inserted into the connector 2 by means of the cable support 11, which is situated at the side of the body 8 furthest away from the contact face 10. Such a twin coax or pair of cables can be clamped in the cable support 11 by means of a crimp connection. The outer conductors of such coaxial cables (not shown) in the fitted state are electrically connected to the outer conductor 12 of the connector 2, since the cable support 11 and the outer conductor 12 are integral. The outer conductor 12, which is preferably made of thin sheet metal, surrounds the connector 2 completely, with the exception of the contact face 10 and the side where the cable support 11 is fitted. Fitting the outer conductor 12 around the entire, virtually uninterrupted periphery of the connector 2 produces both a good protection against high-frequency electromagnetic radiation and a better impedance.

The edge 13 of the outer conductor, which when inserted lies close to the feed-through apertures 4 of the holder 1, adjoins the contact face 10. From said edge 13 two contact springs 14 extend backwards, i.e. from the contact face 10 along the connector 2 in the direction of the cable support 11. As shown in FIG. 1, the contact springs 14 are integral with the outer conductor 12, which permits good mechanical and electrical contact and a simple fitting of the components of the connector. The contact springs 14 are made by providing the outer conductor 12 with two projecting strips, which are then bent over. In order to facilitate this bending, in the embodiment of FIG. 1 relatively short and narrow notches 15 are provided on either side of the contact springs. These notches 15 can be very short and can be omitted if desired. In order to produce a greater contact surface, each contact spring in the embodiment shown is provided with a shoulder 16, but this is not essential for the invention.

The holder 1 is also provided with clamping members 17 for clamping the connector 2 when it is fitted in the body 3 of the holder 1. These clamping members 17 have a spring action and are formed in such a way that the connector 2 can be inserted simply into the holder 1 and is locked well when inserted.

FIG. 2 shows two other embodiments of the connector 2 according to the invention. Both embodiments also comprise a body 8, provided with an outer conductor 12 with a contact spring 14. Only one contact hole 9 is provided in these embodiments, which are suitable for connecting one cable, such as a coaxial cable. As can be seen from FIG. 2, the connector 2 can be made either square (rectangular) or round. Other shapes, such as oval, are also possible, provided that the complementary connector is adapted to these shapes.

Figure 3:
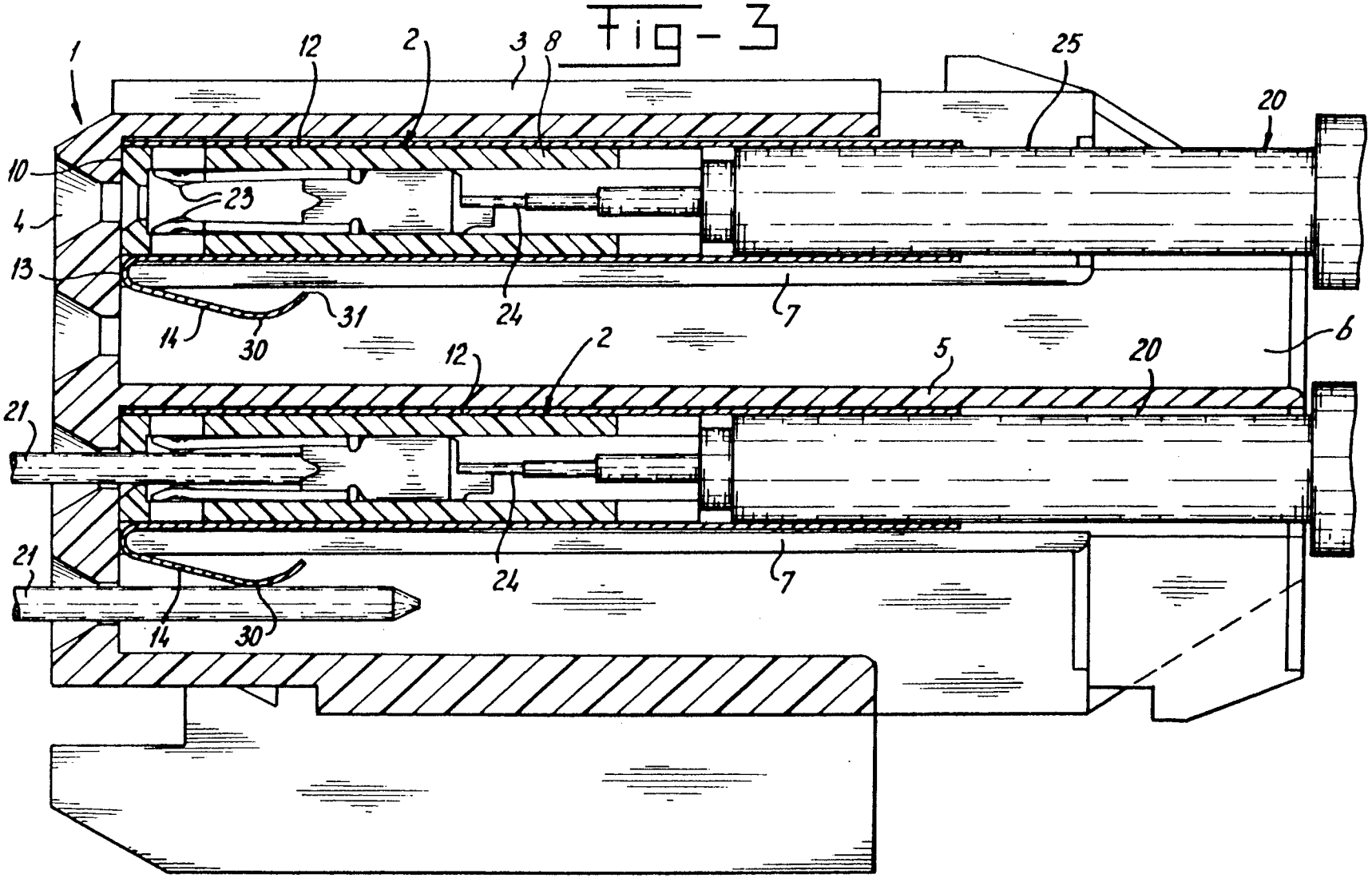
FIG. 3 shows in cross-section an embodiment of the connector according to the invention, inserted into a holder designed for it.

The connectors shown in FIG. 3 according to one embodiment of the invention are inserted into holes of the holder 1 formed for the purpose. These holes are bounded by, inter alia, a supporting floor 5 and supporting walls 6, the supporting walls 6 being provided with positioning ribs 7. A coaxial cable 20 is connected to each of the two connectors 2. The holder 1 of FIG. 3 also has a body 3 with feed-through apertures 4, through which contact pins 21 can be inserted. Two of these contact pins 21, which are fixed to a complementary connector (not shown), are shown by way of illustration in FIG. 3. The contact pin (earth pin) 21, which in the figure lies next to the connector 2 shown as the lower one, makes both mechanical and electrical contact with the contact spring 14 of said lower connector 2. The contact pin (signal pin) 21, which is inserted into the contact hole of said connector 2, contacts a contact member 22 situated in the body 8 of the connector 2 at contact places 23 formed for the purpose. The inner conductors 24 of the coaxial cables 20 are also connected to said contact members 22. The outer conductors 25 of the coaxial cables 20 are clamped in a part of the outer conductor 12 of the connector 2 forming a cable clip. In the embodiment shown, the cable clip is integral with the outer conductor 12 of the connector 2, so that an electrical contact is established between the outer conductor 25 of the coaxial cable and the outer conductor 12 of the connector 2.

The contact springs 14 extending from the edge 13 lying near the contact face 10 of the connector 2 have a contact place 30 which is formed by a slight curvature of the contact springs 14. Such a curvature causes an increased local contact pressure and thus ensures an improved electrical contact between the contact pins 21 and the contact springs 14. In order to make the insertion of the connectors easier, the contact springs 14 are formed in such a way that they have a relatively long first part extending essentially between the edge 13 and the contact place 30. This first part forms a slight angle relative to the body 8, so that on insertion of the connectors the spring force of the contact springs 14 against the contact pins (earth pins) 21 is increased only slowly.

The second part of the contact springs 14 lying between the contact place 30 and the free end 31 forms a larger and opposite angle relative to the body 8, in order to provide the curvature of the contact places 30. The ratio between the length of the contact springs 14 and the force exerted by said contact springs 14 on the contact pins 21 is selected in such a way that, on the one hand, the connector 2 can be pushed easily along the contact pins 21 and, on the other, the spring force is sufficient to ensure a good electrical contact.

In the embodiment shown in FIG. 3 the connectors 2 each contact two contact pins 21, one of which is an earth pin, and one a signal pin. It is also possible to make the connector according to the invention in such a way that each set of contact pins 21 has two signal pins and one earth pin. The signal/earth ratio of the contact pins depends on the number and the positions of the contact places in the connector, this number and these positions being determined by the signal pins and contact members inside the connector and the contact springs outside the connector.

Other cables can also be used instead of the coaxial cables shown. A greatly reduced energy loss from radiation will always be achieved by not cutting the contact springs 14 out of the surface of the outer conductor 12, but forming them, for example, by means of a strip projecting outside the outer conductor 12 and bending it back.

It will be understood that various changes and modifications can be made in the embodiments described above without departing from the spirit and the scope of the present invention.

What is claimed is:

1. A connector, comprising a body of electrically insulating material, contact members fitted in said body, and an outer conductor fitted around said body, said body being provided at a contact side with one or more contact holes for receiving signal pins of a complementary connector and contacting said signal pins with said contact members, said outer conductor being provided with one or more strip-type contact springs extending along said connector for contacting earth pins of said complementary connector, said contact springs being made integral with said outer conductor, and an edge of said outer conductor lying at least in the vicinity of said contact side of said body, characterised in that said contact springs extend essentially from said edge along said outer conductor, in such a way that said outer conductor has an essentially uninterrupted outer periphery.

2. A connector according to claim 1, wherein said edge of said outer conductor adjoins said contact side of said body.

3. A connector according to claim 1, wherein contact springs are fitted on opposite sides of said connector.

4. A connector according to claim 1, wherein at least two adjacent contact springs are provided at one side of said connector.

5. A connector according to claim 1, wherein a contact spring for contacting more than one earth pin is split over at least a part of its length.

6. A connector according to claim 1, having an essentially rectangular periphery.

7. A flat blank of electrically conducting sheet material for forming therefrom said outer conductor of said connector according to claim 1.

8. A connector according to claim 1, which is provided with means for connecting at least one coaxial cable.

9. A connector according to claim 8, wherein said coaxial cable is a twin coax.

10. A connector, comprising a body of electrically insulating material, contact members fitted in said body, and an outer conductor fitted around said body, said body being provided at a contact side with one or more contact holes for receiving signal pins of a complementary connector and contacting said signal pins with said contact members, said outer conductor being provided with one or more strip-type contact springs extending along said connector for contacting earth pins of said complementary connector, said contact springs being made integral with said outer conductor, and an edge of said outer conductor lying at least in the vicinity of said contact side of said body, wherein said contact springs extend essentially from said edge along said outer conductor, in such a way that said outer conductor has an essentially uninterrupted outer periphery, and wherein said edge of said outer conductor adjoins said contact side of the body.

11. A connector according to claim 10, wherein contact springs are fitted on opposite sides of said connector.

12. A connector according to claim 10, wherein at least two adjacent contact springs are provided at one side of said connector.

13. A connector according to claim 10, wherein a contact spring for contacting more than one earth pin is split over at least a part of its length.

14. A connector according to claim 10, having an essentially rectangular periphery.

15. A flat blank of electrically conducting sheet material for forming therefrom said outer conductor of said connector according to claim 10.

16. A connector according to claim 10, which is provided with means for connecting at least one coaxial cable.

17. A connector according to claim 16, wherein said coaxial cable is a twin coax.

18. A connector, comprising a body of electrically insulating material, contact members fitted in said body, and an outer conductor fitted around said body, said body being provided at a contact side with one or more contact holes for receiving signal pins of a complementary connector and contacting said signal pins with said contact members, said outer conductor being provided with one or more strip-type contact springs extending along said connector for contacting earth pins of said complementary connector, said contact springs being made integral with said outer conductor, and an edge of said outer conductor lying at least in the vicinity of said contact side of said body, wherein said contact springs extend essentially from said edge along said outer conductor, in such a way that said outer conductor has an essentially uninterrupted outer periphery, and wherein said edge of said outer conductor adjoins said contact side of said body, and wherein contact springs are fitted on opposite sides of said connector being provided with means for connecting of at least one coaxial cable.

19. A connector according to claim 18, having an essentially rectangular periphery.

20. A flat blank of electrically conducting sheet material for forming therefrom said outer conductor of said connector according to claim 18.

* * * * *